US006392963B1

(12) United States Patent
McGinnis-Smith et al.

(10) Patent No.: US 6,392,963 B1
(45) Date of Patent: May 21, 2002

(54) CHILDREN'S TIMER DEVICE FOR INDICATING WAKING TIME AND SLEEPING TIME

(75) Inventors: K. Anya McGinnis-Smith, 537 Clermont St., Denver, CO (US) 80220; Edward L. Altshuler, Boulder, CO (US)

(73) Assignee: K. Anya McGinnis-Smith, Denver, CO (US)

( * ) Notice: Subject to any disclaimer, the term of this patent is extended or adjusted under 35 U.S.C. 154(b) by 0 days.

(21) Appl. No.: 09/412,561

(22) Filed: Oct. 5, 1999

Related U.S. Application Data

(60) Provisional application No. 60/103,348, filed on Oct. 7, 1998.

(51) Int. Cl.[7] ..... G04F 10/00

(52) U.S. Cl. ..... 368/107; 368/89

(58) Field of Search ..... 368/108, 107, 368/26, 78, 229, 223, 222, 259, 260

(56) References Cited

U.S. PATENT DOCUMENTS 372,074 A * 10/1887 Kuhn ..... 368/107
D149,106 S 3/1948 Berryman
D172,317 S 5/1954 Shellman
3,608,214 A 9/1971 Racanti
3,763,648 A 10/1973 Pakter et al.
4,759,002 A 7/1988 Cash
4,993,006 A 2/1991 Oshima et al.
5,044,961 A 9/1991 Bruskewitz
5,327,403 A * 7/1994 Bond ..... 368/107

* cited by examiner

*Primary Examiner*—Bernard Roskoski
(74) *Attorney, Agent, or Firm*—Emery L. Tracy

(57) ABSTRACT

A children's timer device for assisting children in determining the difference between waking time and sleeping time is provided. The device comprises a housing having a viewing opening and a viewing cylinder rotatably mounted within the housing. The viewing cylinder has at least a first scenic image and a second scenic image with each scenic image alternatingly viewable through the viewing opening in the housing. A clock mechanism sets a predetermined time period for viewing at least the first scenic image wherein upon rotation of the viewing cylinder to display only the first scenic image through the viewing opening, the entire first scenic image remains viewable through the viewing opening for the duration of the predetermined time period such that upon expiration of the predetermined time period, the viewing cylinder begins rotation and rotates until only the second scenic image is viewable through the viewing opening.

20 Claims, 3 Drawing Sheets

SECTION I-I

SECTION I-I

CHILDREN'S TIMER DEVICE FOR INDICATING WAKING TIME AND SLEEPING TIME

The present application is a continuation of pending provisional patent application Serial No. 60/103,348, filed on Oct. 7, 1998, entitled "Children's Clock Device for Indicating Waking Time and Sleeping Time".

BACKGROUND OF THE INVENTION

1. Field of the Invention

This invention relates generally to a timer device for children and, more particularly, it relates to a children's timer device for indicating waking time and sleeping time in an easy and understandable manner.

2. Description of the Prior Art

As a child grows, the child begins to learn that there is a certain time in the morning that he or she should be rising from bed which is generally at the same time or after the time the parents arise. Any time before the rising time, the child learns that he or she should remain in bed until the appropriate time. Unfortunately, depending on the time of year, the child's rising time may or may not coincide with the rising of the sun which only serves to confuse the child.

In the past, many different types of clocks have been invented for a user to determine the time of day or night. Prior art clocks, however, generally do not provide any direct information to an observer, especially a child, as to whether it is daylight (rise time) or nighttime (sleep time). A young child is not able to observe a typical prior art clock to quickly determine whether it is time to get up or time to remain in bed.

There have been unsuccessful attempts in the prior art to have a simple clock device for assisting the child or others. The Cash, U.S. Pat. No. 4,759,002, describes a clock having a housing which contains two internal disks and a motor for rotation of those disks on a shaft. An hour disk is provided having a shaded region representing night and an unshaded region representing day. The clock of the Cash patent merely indicates the hour of the day by pointing to a number on the disk face, and also graphically represents the amount of time from and to the previous and next sunrise or sunset. Due to the complexity of the clock and the multitude of moving numbers, nothing in the Cash patent's clock assists a small child in determining whether it is time to rise or time to remain in bed.

Accordingly, there exists a need for a children's timer device which assists a child in easily determining whether it is time to rise or time to remain in bed. Additionally, a need exists for a children's timer device which indicates waking time and sleeping time in an easy and understandable manner. Furthermore, there exists a need for a children's timer device which helps parents get a complete night's sleep by teaching the child to remain in his or her room until an appropriate time.

SUMMARY

The present invention is a children's timer device for assisting children in determining the difference between waking time and sleeping time. The device comprises a housing having a viewing opening and a viewing cylinder rotatably mounted within the housing. The viewing cylinder has at least a first scenic image and a second scenic image with each scenic image alternatingly viewable through the viewing opening in the housing. Clock means are provided for setting a predetermined time period for viewing at least the first scenic image wherein upon rotation of the viewing cylinder to display only the first scenic image through the viewing opening, the entire first scenic image remains viewable through the viewing opening for the duration of the predetermined time period such that upon expiration of the predetermined time period, the viewing cylinder begins rotation and rotates until only the second scenic image is viewable through the viewing opening.

The present invention further includes a method for assisting children in determining the difference between waking time and sleeping time. The method comprises providing a housing, forming a viewing opening in the housing, providing a viewing cylinder having at least a first scenic image and a second scenic image, rotatably mounting the viewing cylinder within the housing such that each scenic image is alternatingly viewable through the opening in the housing, rotatably positioning the viewing cylinder until only the first scenic image is viewable through the opening, providing clock means for setting a predetermined time period for viewing the first scenic image, and automatically rotating the viewing cylinder to display only the second scenic image upon expiration of the predetermined time period upon expiration of the predetermined time period.

The present invention still further includes a timer device. The timer device comprises a substantially cylindrical enclosure having a closed end, an open end, and a substantially circular side wall. A viewing opening is formed in the side wall between the closed end and the open end. A viewing cylinder is rotatably mounted within the enclosure with the viewing cylinder having at least a first scenic image and a second scenic image and each scenic image alternatingly viewable through the viewing opening in the enclosure. A base plate is releasably secured to the open end of the enclosure, the base plate positionable on a surface. Clock means are mounted on the base plate for setting a predetermined time period for viewing at least the first scenic image such that the entire first scenic image remains viewable through the viewing opening for only the duration of the predetermined time period whereupon the viewing cylinder rotates until only the second scenic image is viewable through the viewing opening.

BRIEF DESCRIPTION OF THE DRAWINGS

The accompanying drawings illustrate complete preferred embodiments of the present invention according to the best modes presently devised for the practical application of the principles thereof, and in which.

DETAILED DESCRIPTION OF THE PREFERRED EMBODIMENTS

Figure 1:
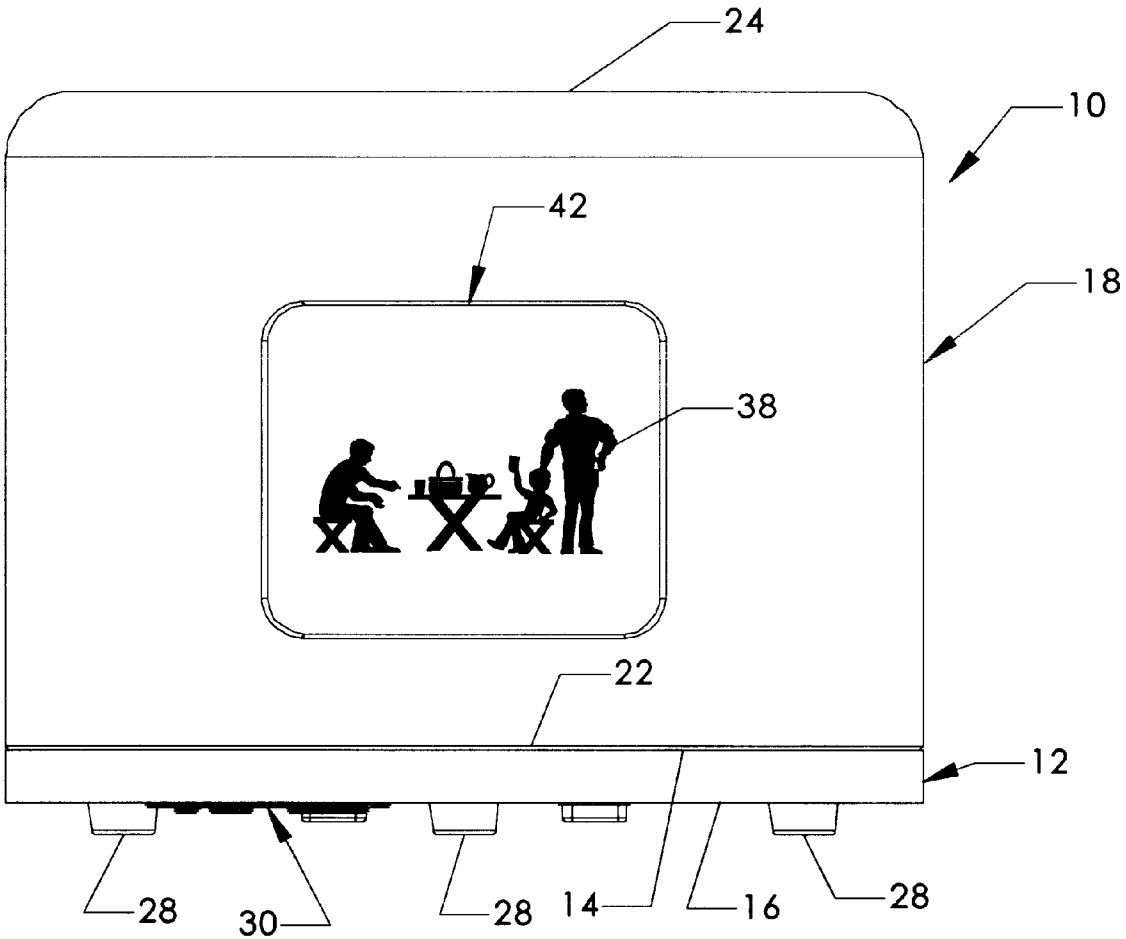
FIG. 1 is a side view illustrating a children's timer device for indicating waking time and sleeping time constructed in accordance with the present invention which indicates to a child that it is time to rise.
Figure 2:
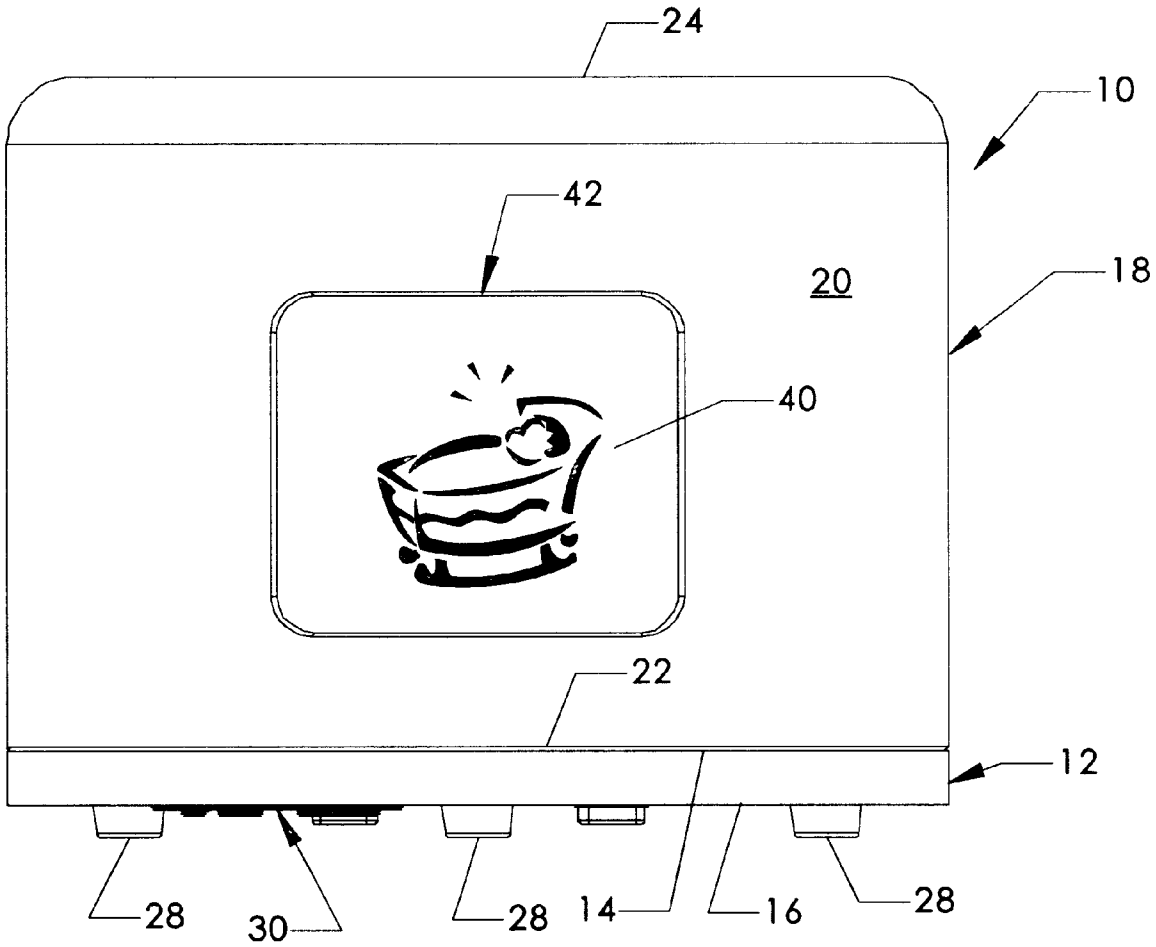
FIG. 2 is another side view illustrating the children's timer device for indicating waking time and sleeping time constructed in accordance with the present invention which indicates to a child that it is time to remain in bed.

As illustrated in FIG. 1, the present invention is a children's timer device, indicated generally at 10, for indicating waking time (see FIG. 1) and sleeping time (see FIG. 2). The timer device 10 of the present invention is designed and shaped to be positioned on a positioning surface (not shown), such as a shelf, dresser, or bedside table, for viewing by a young child from his or her bed (not shown) such that the child can easily view the timer device 10 to determine if he or she should remain in bed or if it is time to get out of bed, as will be described further below.

Figure 4:
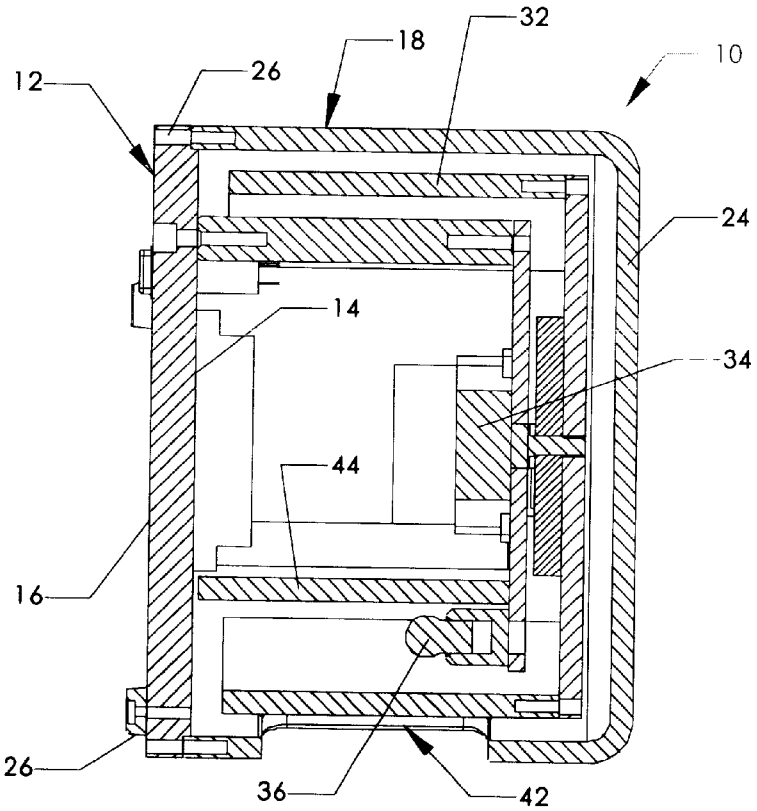
FIG. 4 is a cross-sectional view taken along line A—A in FIG. 3 illustrating the children's timer device for indicating waking time and sleeping time constructed in accordance with the present invention.
Figure 3:
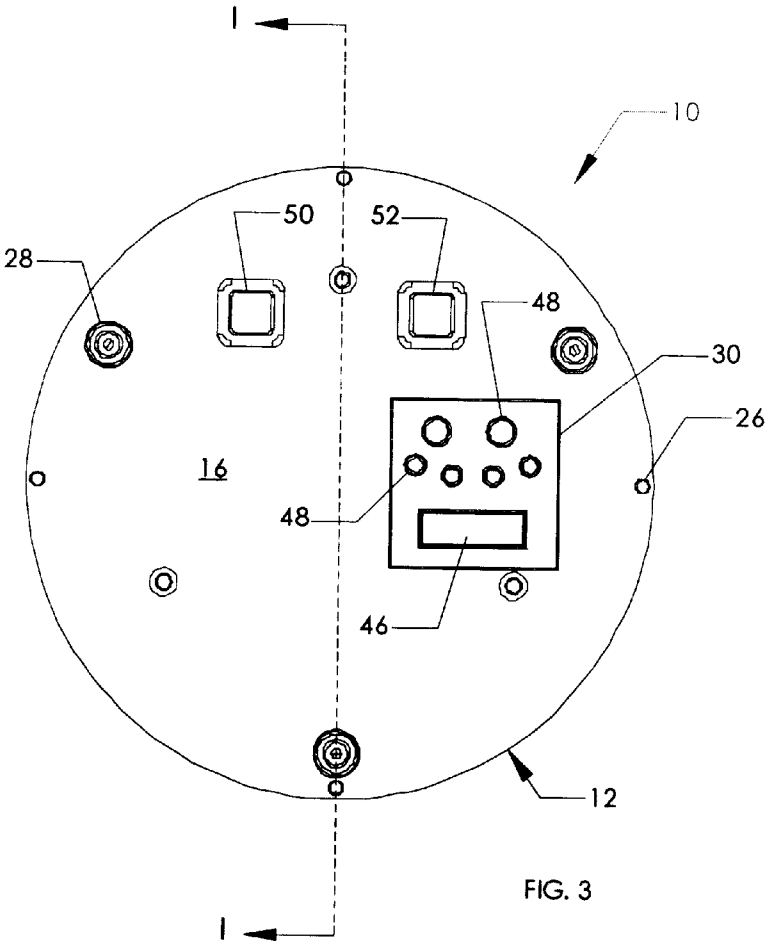
FIG. 3 is bottom view illustrating a base for the children's timer device for indicating waking time and sleeping time constructed in accordance with the present invention.

The timer device 10, as illustrated in FIG. 1, has a base plate 14 having a top surface 16 and a bottom surface 18 and a substantially cylindrical housing 18 having an wall 20, an open end 22, and a closed end 24. The open end 22 of the housing 18 is preferably releasably mounted to the top surface 14 of the base plate 12 by a plurality of threaded screws 26 or the like, as illustrated in FIGS. 3 and 4. The plurality of screws 26 extend completely through the base plate 12 from the bottom surface 16 to the top surface 14 and into the wall 20 of the housing 18 to accomplish the releasable mounting of the open end 22 of the housing 18 to the top surface 14 of the base plate 12. While the housing 18 has been described as being releasably secured to the top surface 14 of the base plate 12 by a plurality of screws 26, it is within the scope of the invention to releasably mount the open end 22 of the housing 18 to the top surface 14 the base plate 12 with other types of fastening mechanisms including, but not limited to, nuts and bolts, etc.

As illustrated in FIGS. 1 and 2, the timer device 10 preferably has a plurality of resilient bumpers 28 mounted on the bottom surface 16 of the base plate 12. The resilient bumpers 28 tend to inhibit the bottom surface 16 of the base plate 12 of timer device 10 from sliding on or scarring the shelf, dresser, or bedside table on which the timer device 10 is positioned. Furthermore, the resilient bumpers 28 position the bottom surface 16 above the positioning surface to protect a clock timing mechanism 30, as described further below.

As illustrated in FIG. 4, the timer device 10 of the present invention further includes a substantially translucent viewing cylinder 32 rotatable within the housing 18 powered by a motor 34 in front of a light source 36. The motor 34 can be either a DC motor powered by a battery (not shown) or a plurality of batteries (not shown) or an AC motor powered by a standard electrical wall outlet (not shown). While the timer device 10 of the present invention has been described as being powered by a DC motor or an AC motor, it is within the scope of the present invention to power the timer device 10 by other means including, but not limited to, solar powered motors, etc.

The viewing cylinder 32 preferably has at least one graphic illustration of a daytime scene 38, as illustrated in FIG. 1, and at least one graphic illustration of a nighttime scene 40, as illustrated in FIG. 2. As the viewing cylinder 32 rotates in front of the light source 36, the light source 36 illuminates either the daytime scene 38 on the viewing cylinder 32 or the nighttime scene 40 on the viewing cylinder 32 depending on the rotational position of the viewing cylinder 32 in the housing 18. Preferably, the light source 36 is a standard low-watt light bulb powered by the same power source as the motor 34, although other types of light sources are within the scope of the present invention.

In addition to the graphic illustrations, i.e., the daytime scene 38 and the nighttime scene 40, on the viewing cylinder 32, the daytime scene 38 and the nighttime scene 40 can be specially colored to further aid the child in determining wake/sleep time. For instance, the daytime scene 38 can be illuminated with a red background and the nighttime scene 40 can be illuminated with a blue background. This can be accomplished with a translucent screen (not shown) with these colors coated on the translucent screen or the colors can be coated directly on the viewing cylinder. The colored daytime scene 38 and the nighttime scene 40 serves as a varied colored nightlight and, more importantly, as an immediate wake/sleep time indicator, especially when viewed from across a room. With the colored scenes, the child need not understand numbers, hands of a clock, or hands pointing to one of potentially twelve pictures associated with the numbers. Recognition by the child is immediate and simple by means of color for either the daytime scene 38 or the nighttime scene 40.

The housing 18 of the timer device 10 includes an open viewing aperture 18 formed in the housing 18 with the viewing cylinder 32 rotating between the light source 36 and the viewing aperture 42. The viewing aperture 32 is sized and shaped for viewing the daytime scene 38 on the viewing cylinder 32 and the nighttime scene 40 on the viewing cylinder 32 by the child or others. A transparent glass or plastic barrier window can be preferably positioned within the viewing aperture 42 to inhibit young children from reaching through the viewing aperture 42 to touch the viewing cylinder 32. Actual operation of the timer device 10 of the present invention will be described in further detail below.

As illustrated in FIG. 4, the timer device 10 further includes a stationary opaque back plate 44 securely positioned behind the light source 36 opposite the viewing cylinder 32. The back plate 44 is preferably mounted to the base plate 44 within the housing 18 and inhibits a child or other from viewing the internal workings, i.e., the motor 34, etc., of the timer device 10 through the viewing aperture 42 and the viewing cylinder 32.

As illustrated in FIG. 3, the timer device 10 also includes the clock timing mechanism 30, as briefly mentioned above, mounted to the base plate 12 and electrically connected to the viewing cylinder 32. The clock timing mechanism 30 has a display 46 for displaying the amount of time programmed by the parents or guardians, and a plurality of depressible buttons 48 for setting the clock timing mechanism 30 for the amount of time the nighttime scene 40 of the viewing cylinder 32 will be displayed through the viewing aperture 42 of the housing 18. The clock timing mechanism 30 is programmable to set the amount of time the nighttime scene 40 is displayed, as will be described further below, before rotating back to display the daytime scene 38 on the viewing cylinder 32 through the viewing aperture 42 of the housing 18.

As illustrated in FIG. 3, the timer device 10 of the present invention further includes a first depressible button or switch 50 for powering the motor 34 and a second depressible button or switch 52 for starting the clock timing device 30 and rotating the viewing cylinder 32 to display the nighttime scene 40. It should be noted that while the timer device 10 of the present invention has been described as having a first and second depressible button 50 and 52, other embodiments, including having only one button for starting the motor 34 and starting the clock timing device 10 are within the scope of the present invention.

The operation of the timer device 10 of the present invention will now be described with reference to FIGS. 1–4. In operation of the timer device 10 of the present invention, the parents or guardians of the child first determine the amount of time for which the nighttime scene 40 on the viewing cylinder 32 will be displayed and for which the child should remain in bed. The parents or guardians can then program the clock timing mechanism 30 for the determined amount of time for which the nighttime scene 40 will be displayed. For instance, if the parents or guardians determine that the child should remain in bed for ten (10) hours during the night, then the parents or guardians program the clock timing mechanism 30 to display the nighttime scene 40 for ten (10) hours. The parents or guardians then depress the first button 50 to power the motor 34. Next, the parents or guardians depress the second button 52 to begin the clock timing mechanism 30 and rotate the viewing cylinder 32 to display the nighttime scene 40. At the end of the ten (10) hours, the viewing cylinder 32 will rotate to display the daytime scene 38 through the viewing aperture 42 in the housing 18 thereby indicating to the child that he or she is permitted to rise.

Furthermore, while the timer device 10 has been described as being set by depressible buttons 50, 52 and powered by a motor 34, it is within the scope of the present invention to set and power the timer device 10 by a variety of means including, but not limited to, a wind-up mechanism with key or knob to set the wind-up mechanism, digital programming, alphanumeric key pads, etc.

It should be noted that the inventor of the present application understands that depending on the time the child is put to bed, the amount of time for which the child should remain in bed may differ from night to night. Therefore, the clock timing mechanism 30 of the timer device 10 of the present invention is easily programmable to allow for the parents or guardians to change or adjust the amount of time for which the nighttime scene 40 will be displayed through the viewing aperture 42 and for which the child should remain in bed or for teaching the child to remain in their bedroom without waking others.

The timer device 10 of the present invention is a novel and useful invention for teaching children about when to rise from their beds in the morning. Except during a brief rotation period from the nighttime scene 40 to the daytime scene 38 at the time of the child's appropriate rising time, only the nighttime scene 40 on the viewing cylinder 32 is illuminated. This inhibits the child's confusion which could occur when a part of both the daytime scene 38 and the nighttime scene 40 are illuminated. Furthermore, the timer device 10 of the present invention such that the timer device 10 can be used as a night light for comforting children in the dark.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein, may be suitably practiced in the absence of the specific elements which are disclosed herein.

We claim:

1. A children's timer device for assisting children in determining the difference between waking time and sleeping time, the device comprising:

a housing, the housing having a viewing opening;

a viewing cylinder rotatably mounted within the housing, the viewing cylinder having at least a first scenic image and a second scenic image, each scenic image alternatingly viewable through the viewing opening in the housing; and clock means for setting a predetermined time period for viewing at least the first scenic image, the predetermined time period being changeable and adjustable;

wherein upon rotation of the viewing cylinder to display only the first scenic image through the viewing opening, the entire first scenic image remains viewable through the viewing opening for the duration of the predetermined time period such that upon expiration of the predetermined time period, the viewing cylinder automatically begins rotation and rotates a predetermined distance until only the second scenic image is viewable through the viewing opening.

2. The children's timer device of claim 1 wherein the first scenic image is a nighttime image for indicating sleeping time and the second scenic image is a daytime image for indicating waking time.

3. The children's timer device of claim 1 and further comprising:

a first color associated with the first scenic image; and a second color associated with the second scenic image.

4. The children's timer device of claim 1 wherein the viewing cylinder is translucent and further comprising:

illumination means for illuminating the first scenic image and the second scenic image through the viewing opening.

5. The children's timer device of claim 4 wherein the illumination means is a light bulb.

6. The children's timer device of claim 1 and further comprising:

a motor for rotating the viewing cylinder upon expiration of the predetermined time period.

7. The children's timer device of claim 1 wherein the clock means includes a clock timing device programmable to a predetermined time for viewing the first scenic image through the viewing opening.

8. The children's timer device of claim 1 wherein the housing comprises:

a substantially cylindrical enclosure having a closed end, an open end, and a substantially circular side wall, the viewing opening being formed in the side wall between the closed end and the open end; and a base plate releasably secured to the open end of the enclosure, the base plate positionable on a surface, the clock means mounted to the base plate.

9. The children's timer device of claim 1 and further comprising:

first activation means for powering the device.

10. The children's timer device of claim 1 and further comprising:

second activation means for activating the clock means to begin timing the duration of the first scenic image in the viewing opening until the expiration of the predetermined time period.

11. The children's timer device of claim 1 and further comprising:

a transparent barrier member within the viewing opening.

12. A method for assisting children in determining the difference between waking time and sleeping time, the method comprising:

providing a housing;

forming a viewing opening in the housing;

providing a viewing cylinder having at least a first scenic image and a second scenic image;

rotatably mounting the viewing cylinder within the housing such that each scenic image is alternatingly viewable through the opening in the housing;

rotatably positioning the viewing cylinder until only the first scenic image is viewable through the opening;

providing clock means for setting an adjustable and changeable predetermined time period for viewing the first scenic image; and automatically rotating the viewing cylinder a predetermined distance to display only the second scenic image upon expiration of the predetermined time period.

13. The method for assisting children in determining the difference between waking time and sleeping time of claim 12 wherein the first scenic image is a nighttime image for indicating sleeping time and the second scenic image is a daytime image for indicating waking time.

14. The method for assisting children in determining the difference between waking time and sleeping time of claim 12 wherein the viewing cylinder is translucent and further comprising:

illuminating the first scenic image and the second scenic image through the viewing opening.

15. The method for assisting children in determining the difference between waking time and sleeping time of claim 12 and further comprising:

providing a motor for rotating the viewing cylinder upon expiration of the predetermined time period.

16. The method for assisting children in determining the difference between waking time and sleeping time of claim 12 wherein the clock means includes a clock timing device programmable to a predetermined time for viewing the first scenic image through the viewing opening.

17. The method for assisting children in determining the difference between waking time and sleeping time of claim 12 and further comprising:

providing first activation means for powering the device; and providing second activation means for activating the clock means to begin timing the duration of the first scenic image in the viewing opening until the expiration of the predetermined time period.

18. The method for assisting children in determining the difference between waking time and sleeping time of claim 11 and further comprising:

providing a transparent barrier member within the opening.

19. A timer device, the device comprising:

a substantially cylindrical enclosure having a closed end, an open end, and a substantially circular side wall;

a viewing opening formed in the side wall between the closed end and the open end;

a viewing cylinder rotatably mounted within the enclosure, the viewing cylinder having at least a first scenic image and a second scenic image, each scenic image alternatingly viewable through the viewing opening in the enclosure;

a base plate releasably secured to the open end of the enclosure, the base plate positionable on a surface; and clock means mounted on the base plate for adjustably setting a predetermined time period for viewing at least the first scenic image such that the entire first scenic image remains viewable through the viewing opening for only the duration of the predetermined time period whereupon the viewing cylinder automatically rotates a predetermined distance until only the second scenic image is viewable through the viewing opening.

20. The timer device of claim 1 and further comprising bumpers mounted to the base plate for spacing the base plate from the surface.

* * * * *